US008056761B2

(12) United States Patent
Delgado

(10) Patent No.: US 8,056,761 B2
(45) Date of Patent: Nov. 15, 2011

(54) POURING DEVICE

(76) Inventor: Raúl Acarreta Delgado, Tudela (ES)

( * ) Notice: Subject to any disclaimer, the term of this patent is extended or adjusted under 35 U.S.C. 154(b) by 738 days.

(21) Appl. No.: 11/596,103

(22) PCT Filed: May 13, 2004

(86) PCT No.: PCT/ES2004/070035

§ 371 (c)(1),
(2), (4) Date: Nov. 30, 2007

(87) PCT Pub. No.: WO2005/110883

PCT Pub. Date: Nov. 24, 2005

(65) Prior Publication Data

US 2009/0039082 A1 Feb. 12, 2009

(51) Int. Cl.
*B67D 1/00* (2006.01)

(52) U.S. Cl. ..... 222/67; 222/496; 222/518; 222/563; 215/266; 220/203.1; 220/203.23

(58) Field of Classification Search ..... 222/61–62, 222/496, 501, 509, 518, 67, 147, 247, 264, 222/511, 544, 563–564; 215/14, 17–30, 215/266, 317, 339–340; 239/569–570, 583; 401/214; 220/202, 203.1, 203.2, 203.23
See application file for complete search history.

(56) References Cited

U.S. PATENT DOCUMENTS

| | | | | | |
|---|---|---|---|---|---|
| 830,605 | A | * | 9/1906 | Lovett | 215/26 |
| 1,875,184 | A | * | 8/1932 | Steigleder | 401/186 |
| 2,970,722 | A | * | 2/1961 | Levenson | 222/62 |
| 3,620,228 | A | * | 11/1971 | Schmid | 137/237 |
| 4,281,779 | A | * | 8/1981 | Shepard | 222/501 |
| 4,377,242 | A | * | 3/1983 | Snedker | 215/21 |
| 4,723,694 | A | * | 2/1988 | Sykes | 222/518 |
| 5,000,353 | A | * | 3/1991 | Kostanecki et al. | 222/207 |
| 5,988,415 | A | * | 11/1999 | White | 215/266 |
| 5,996,860 | A | * | 12/1999 | Alley | 222/564 |

FOREIGN PATENT DOCUMENTS

| | | |
|---|---|---|
| EP | 0 633 195 | 1/1995 |
| FR | 793904 | 2/1936 |
| GB | 416600 | 9/1934 |

* cited by examiner

*Primary Examiner* — Kevin P Shaver
*Assistant Examiner* — Andrew Bainbridge
(74) *Attorney, Agent, or Firm* — Ladas & Parry LLP

(57) ABSTRACT

A pouring device for a liquid filled container that fits into the neck of a container opening. The pouring device has a buoyant hollow ball valve that when the container or bottle is seated in its normal vertical storage position is pressed against an inner lip of the pouring device to form a seal by a spring that is seated on a distal inner lip of the pouring device. The valve opens when the container is inverted as the hollow ball valve is so buoyant that it overcomes the spring bias, thereby allowing the container's fluid contents to pour out. The hollow ball valve's movement is controlled by at least one vertical projection along the length of the pouring device.

10 Claims, 3 Drawing Sheets

POURING DEVICE

OBJECT OF THE INVENTION

The present invention generally refers to a pouring device which allows for preventing the outflow of a liquid contained in a liquid container.

More specifically, the present invention refers to a ball valve which can be inserted in the mouth of a liquid container, such that its outlet opening remains closed while the container tilts from a normal vertical position to a horizontal position, that is, parallel to the floor.

STATE OF THE ART

Different containers or recipients incorporating ball valves for, for example, preventing the filling of the container with liquid from the exterior, a stopper which cannot be filled, as a metering device releasing a predetermined amount of liquid every time the container is made to tilt, are already known.

However, these ball valve devices have the disadvantage, as a result of their design, that they are not able to prevent the liquid stored in the container from flowing out of the interior of the container to the exterior thereof when the container is accidentally or deliberately tilted from a normal vertical position to a horizontal position, that is, parallel to a flat surface such as, for example, the floor.

D1 (EP 0 633 195) disclosed refillable bottle closure comprising a heavy disc valve seats over a valve seat and a spring that exerts pressure over heavy flat valve to prevent the outlet liquid contaminate the inlet liquid. The heavy flat valve is arranged on the top of the container neck following by the valve seat.

Therefore, it is necessary to develop a pouring device including a ball valve for preventing the liquid contained in a container from spilling through the inlet/outlet hole or access opening of the valve, from inside the container towards the exterior thereof when the container is tilted from a normal vertical position to a horizontal position parallel to a flat surface such as a floor.

CHARACTERIZATION OF THE INVENTION

The present invention aims to solve or reduce one or more of the drawbacks previously set forth by means of an improved liquid pouring device comprising a plugging means closing an outlet hole of the pouring device in a normal vertical position of the container, an annular ring serving as a seating for the plugging means, from which at least one vertical guide projection projects, distributed in the outline of the annular ring in a manner substantially parallel to the longitudinal axis of the pouring device, having a substantially inward projection at the end opposite to the outlet hole, perpendicular to the longitudinal axis serving as a seating for a return spring.

One object of the invention is to develop a pouring device comprising a reduced number of parts which are relatively easily constructed and assembled, ensuring the obtainment of a liquid pouring device which requires a reduced number of components and manpower for its assembly, thus obtaining a reduced cost pouring device.

Another further object of the present invention is to provide a pouring device with a design susceptible to being used in different types of containers.

Yet another object of the present invention is to simplify the manufacturing process by molding and assembly of the different parts forming the pouring device.

Therefore, the present invention allows for simplifying and economizing the manufacture of the pouring device, improving industrial efficacy.

BRIEF DESCRIPTION OF THE FIGURES

The devices materializing the invention will now be described by way of example only, with reference to the attached schematic drawings in which.

DESCRIPTION OF THE INVENTION

Figure 1:
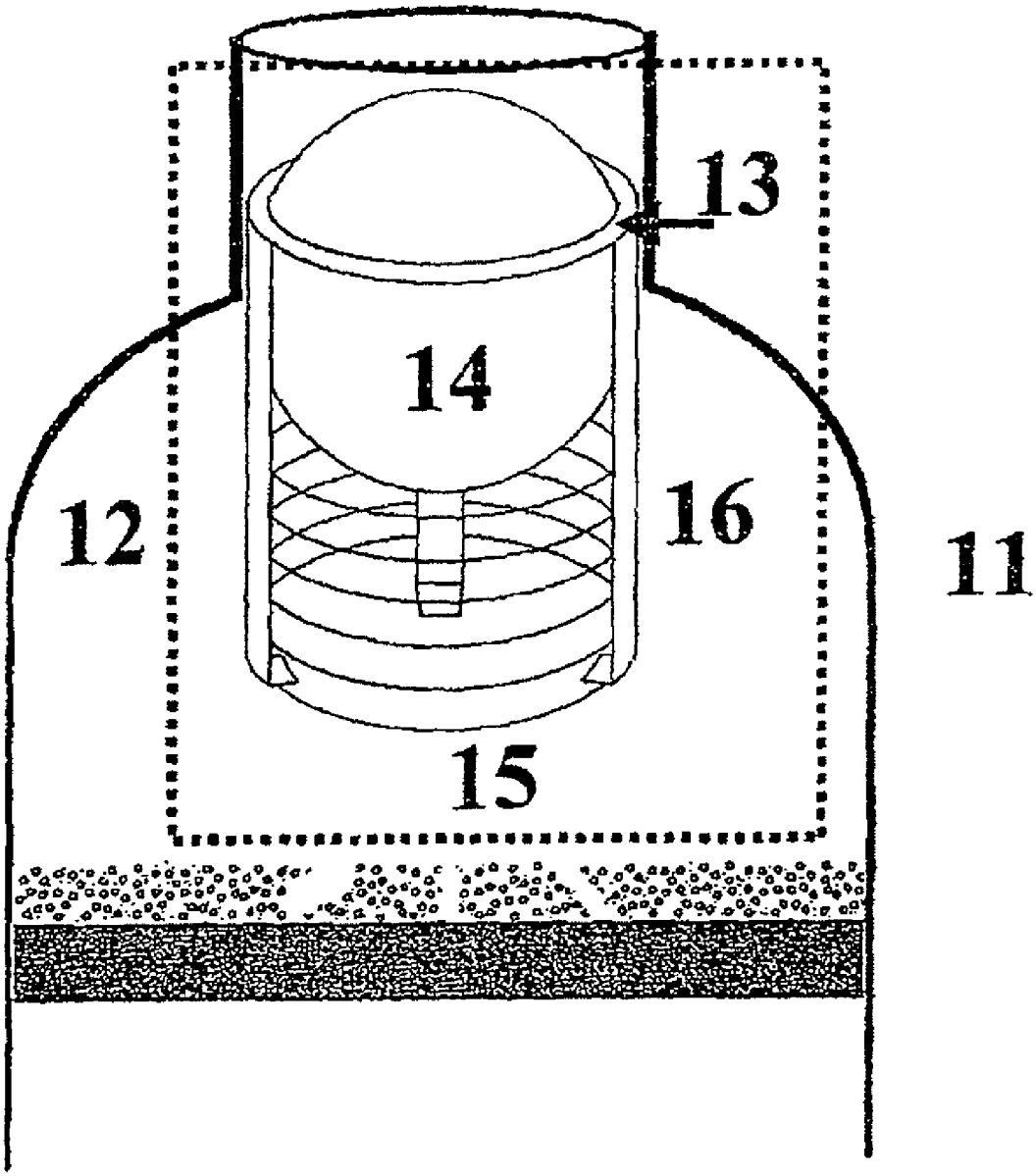
FIG. 1 shows an elevational view, and sectioned by a vertical plane, of a pouring device according to the invention.

FIG. 1 shows a pouring device 12 comprising a hollow cylindrical pouring body with rotational symmetry, configured, for example, by molding, of a tubular cylindrical section according to a longitudinal axis, to hermetically fit inside the neck or outlet opening of a recipient such as a bottle 11, serving as a conduit for passage of the liquid stored in the bottle 11.

The pouring device 12 has an annular ring 13 on its upper portion projecting towards the longitudinal axis of the pouring device 12 serving as a seating or closure to a plugging means 14, susceptible to being displaced between an opening position of the access hole or inlet hole, corresponding to an inverted position of the container, and a closed position, corresponding to a normal vertical position of the container 11.

The pouring device 12 has a plurality of vertical projections 16 at its lower portion, namely, guide arms or ribs regularly distributed throughout the outline of the annular ring 13 which is suitably extended towards the interior of the container in a manner substantially parallel to the longitudinal axis of the pouring device 12, having an L-type shape with a bracket in the lower portion and inwards, demarcating a cylindrical space.

The guide ribs 16 cooperate with a return spring 15 to maintain the plug 14 in the closed position.

The plugging means 14 and the spring 15 must be housed in the housing formed between the upper portion of the pouring device 12, that is, ring 13 and the opposite lower portion of the ribs 16.

The plug 14 must have any suitable shape to be introduced by pressure in the housing formed in the pouring device 12 due to bending deformation of the ribs 16, for example, the plug has a hollow ball-type shape.

Also, it must be observed that all the elements of the pouring device 12 can be carried out with the same material, being able to be manufactured by molding from a flexible material such as a plastic material.

Once the plug 14 is introduced, the spring 15, namely, an elastic part such as a loaded spring, must be introduced by bending deformation, such that one of the ends of the spring 15 is resting on the portions of the ribs 16 substantially progressing in a perpendicular manner towards the central longitudinal axis of the pouring device 12, that is, the footing or base parallel to the annular ring 13 existing at the upper portion of the pouring device 12, and the other end is resting on an end of the spherical plug 14.

As a result of the thrust force carried out by the spring 15, the spherical plug 14 is pushed towards the annular ring 13, such that the access hole of the pouring device 12 is closed in normal vertical position and in horizontal position and accordingly, in each of the intermediate positions between both closed positions.

When the force exerted by the column of liquid on said plug 14 exceeds the force exerted by the spring 15, the liquid stored inside the container 11 can flow out to the exterior thereof.

Normally, the latter will occur when the longitudinal axis of the container 11 forms a positive acute angle with a plane that is horizontal and parallel to the floor, then the liquid will exert such a hydrostatic pressure that is sufficient for overcoming the force exerted by the spring 16.

Accordingly, a portion of the spherical plug 14 must project from the annular ring 13, said portion is defined by a parallel circle smaller than the larger circle of the spherical plug 14, that is, corresponding to the circle defined by the equator of the spherical plug 14.

In summary, according to whether the container is tilted, the hydrostatic force exerted by the column of liquid on the hollow spherical plug 14 increases after a certain point, becoming greater than the force exerted by the return spring 16, which corresponds to the moment in which the container is partially or completely inverted, i.e., in the pouring position, the bottom of the container 11 is above the mouth of the container, and the plug 14 will move like a floater from the closed position of the access hole to the opposite end of the pouring device 12, allowing the liquid to flow through the outlet hole of the pouring device 12, flowing out to the exterior of the container 11.

In another order of matters, the pouring device 12 can be completed with an external closure cap, being able to be linked at the production source to the pouring device 12 through a tear line, such that the mounted assembly of the annular ring 13, spherical plug 14 and return spring 15 is covered by the closure cap.

It must be observed that the pouring device 12 is constituted of several parts, of which the one determining the pouring portion 12 must be fixed to the neck of the container 11, being constituted only of three assembled parts, that is, the pouring device 12 itself, the plug 14 and the return spring 15.

The plugging means 14 can adopt different three-dimensional-type shapes such as a ball or others, such that when the container is in its normal vertical position, said plug 14 is resting on its seating, preventing the outflow of the liquid stored in the container 11 and, when the container is sufficiently inclined, the plug 14 moves towards the bottom of the container, allowing the outflow of the liquid stored in the container 11.

Figure 3:
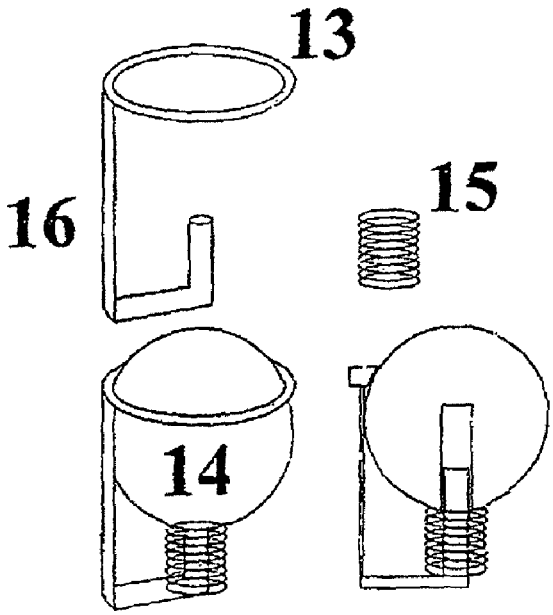
FIG. 3 shows an elevational view, and partially sectioned by a vertical plane, of another embodiment of the pouring device according to the invention.
Figure 4:
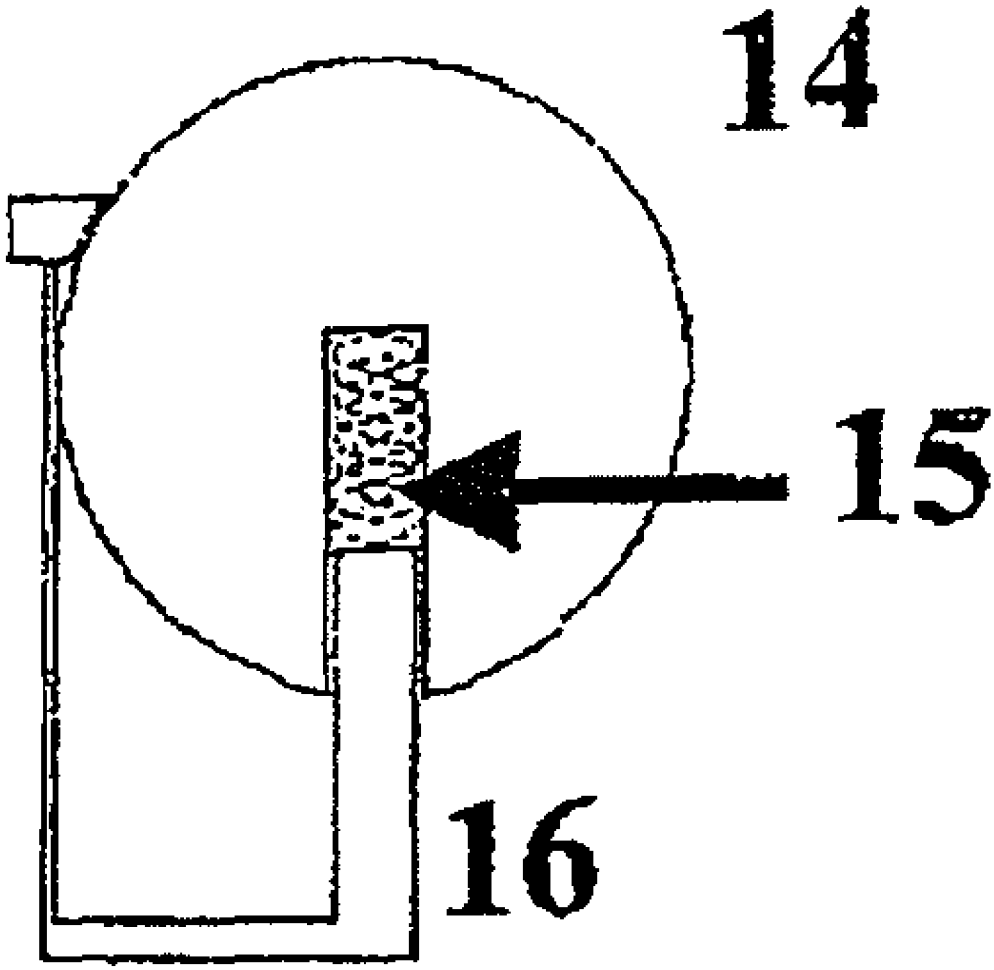
FIG. 4 shows an elevational view, and partially sectioned by a vertical plane, of another embodiment of the pouring device according to the invention.

As is shown in FIGS. 3 and 4, the pouring device 12 can include a single guide rib 16 projecting towards the bottom of the container, having an L-type shape which furthermore has an extension projecting towards the annular ring 13 such that the spring 15 is placed concentrically to said extension.

The plug 14 has a cylindrical cavity, the diameter and depth of which are such that it allows the extension to penetrate in the plug 14.

The spring 16 can be placed in several manners, that is, it can be located outside of the cavity of the plug 14 or inside it, as can be seen in FIG. 4.

Figure 2:
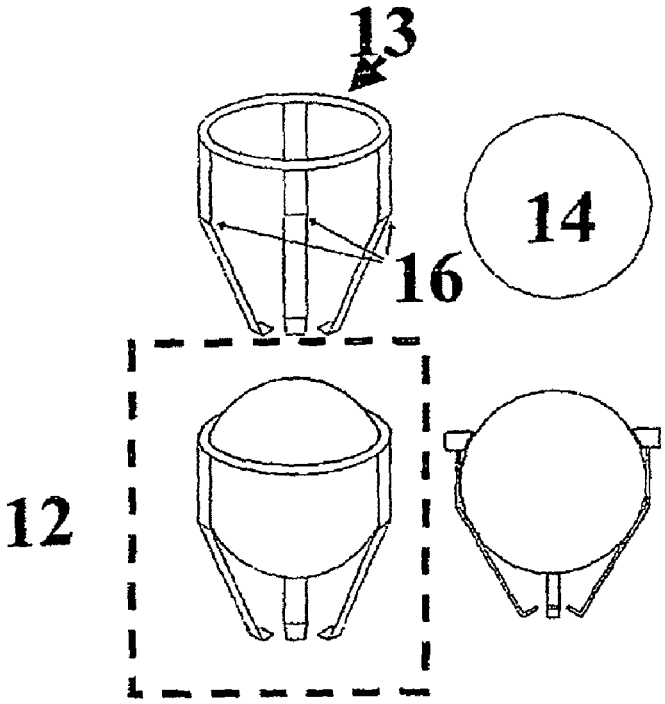
FIG. 2 shows an elevational view, and partially sectioned by a vertical plane, of another embodiment of the pouring device according to the invention.

Regarding FIG. 2, the spring 16 can be avoided if each guide rib 16 is formed by a broken line such that three sections can be distinguished, one of them, in contact with the ring 13 suitably extended towards the interior of the container and in a manner substantially parallel to the longitudinal axis of the pouring device 12, followed by a longitudinal portion which extends, becoming substantially narrower towards the longitudinal axis of the pouring device 12 forming a truncated frusto-conical cylindrical space, namely, a funnel towards the bottom of the container 11. The base of the guide rib 16 comes after it.

When the container 11 is turned over, the thrust which the column of liquid exerts on the plug 14 is sufficient so that the guide ribs 16 bend, allowing the plug to move upwards, that is, towards the bottom of the container allowing the outflow of the liquid.

Once the container recovers its normal vertical position, the force making the guide ribs 16 bend disappears, such that they recover their normal resting position and push the plug 14 upwards, closing the pouring device 12.

A bottle with a tubular cylindrical neck has been taken as an example to give a detailed explanation of the present invention, the latter being applicable to other types of containers having a neck of a cylindrical cross section or different. In this last case, the use of the invention would require modifications for the purpose of adapting the pouring device 12 to the outlet opening of the container.

For example, if the recipient 11 is of rectangular, round box-type or any type in which the outlet opening of the container is integrated on a flat surface, the ring 13 can have a circular or square rim for the fixing thereof to the outlet opening, being able to have an extension body to prevent the plug from projecting from the container.

The invention claimed is:

1. A pouring device for a liquid container including:

a floatable plugging means for closing an opening of the pouring device when the pouring device is in a vertical position;

an annular ring serving as a seating for the floatable plugging means;

at least one vertical guide projection extending from the annular ring in a direction away from the opening and being substantially parallel to a longitudinal axis of the pouring device, and having an inward projection at an end opposite the opening, the inward projection extending substantially perpendicular to the longitudinal axis;

a spring seated on the inward projection of the vertical guide projection at one end and exerting a spring force against the floatable plugging means toward the annular ring to bias the floatable plugging means against the annular ring at a closed position to close the opening of the pouring device.

2. A pouring device according to claim 1; wherein when the floatable plugging means is moved away from the closed position, the floatable plugging means compresses the spring against the inward projection of the vertical guide projection.

3. A pouring device according to claim 2; wherein a portion of the floatable plugging means projects above the annular ring when the pouring device is in the vertical position.

4. A pouring device according to claim 1; further comprising L-shaped vertical guide projections forming a funnel at the end opposite to the opening.

5. A pouring device according to claim 1; wherein the pouring device is made of an elastic material.

6. A liquid container defining an outlet hole, the liquid container comprising a pouring device according to claim 1 installed inside the liquid container near the outlet hole.

7. A pouring device according to claim 3; wherein the floatable plugging means is a hollow ball valve.

8. A pouring device according to claim 5, wherein the elastic material is plastic.

9. A pouring device according to claim 1, wherein the annular ring, the at least one vertical guide projection, and the inward projection are integrally formed.

10. A liquid container according to claim 6, further comprising a liquid inside the container, the pouring device being arranged inside the liquid container near the outlet hole such that the pouring device closes the outlet hole when the liquid container is in a vertical position, and when the liquid container is moved from the vertical position to a pouring position, the liquid inside the liquid container floats the floatable plugging means of the pouring device against the spring away from the outlet hole to permit a flow of the liquid out of the liquid container.

* * * * *